US007255542B2

(12) United States Patent
Lifson et al.

(10) Patent No.: US 7,255,542 B2
(45) Date of Patent: Aug. 14, 2007

(54) COMPRESSOR WITH CHECK VALVE ORIENTATED AT ANGLE RELATIVE TO DISCHARGE TUBE

(75) Inventors: Alexander Lifson, Manlius, NY (US); Bruce A. Fraser, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 98 days.

(21) Appl. No.: 11/140,721

(22) Filed: May 31, 2005

(65) Prior Publication Data

US 2006/0269431 A1 Nov. 30, 2006

(51) Int. Cl.

| | |
|---|---|
| ***F01C 1/063*** | (2006.01) |
| ***F01C 1/00*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |

(52) U.S. Cl. ..... 418/55.1

(58) Field of Classification Search ..... 417/571, 417/269; 418/55.1–55.6; 137/511, 38; 166/332.8
See application file for complete search history.

(56) References Cited

U.S. PATENT DOCUMENTS

| | | | | |
|---|---|---|---|---|
| 5,088,905 | A * | 2/1992 | Beagle | 417/55.1 |
| 5,207,898 | A * | 5/1993 | Hodgkins | 210/136 |
| 5,456,287 | A * | 10/1995 | Leu | 137/855 |
| 5,562,425 | A * | 10/1996 | Kimura et al. | 417/269 |
| 5,871,337 | A * | 2/1999 | Fukanuma et al. | 417/222.2 |

* cited by examiner

*Primary Examiner*—Thomas Denion
*Assistant Examiner*—Douglas J. Duff
(74) *Attorney, Agent, or Firm*—Carlson, Gaskey & Olds

(57) ABSTRACT

A unique positioning of a discharge tube relative to a pivot axis of a check valve in a compressor reduces the wear and fatigue stresses on the pivoting check valve components. The tube is centered on an axis that is non-perpendicular to an axis that is parallel to the pivot axis of the check valve, and in one embodiment was at 45°. With the inventive positioning of the discharge tube relative to the pivot axis, the flow streamlines heading from the discharge port to the discharge tube are no loner normal to the flapper valve surface, and the amount of wear between moving valve components and fatigue stresses are reduced.

9 Claims, 3 Drawing Sheets

COMPRESSOR WITH CHECK VALVE ORIENTATED AT ANGLE RELATIVE TO DISCHARGE TUBE

BACKGROUND OF THE INVENTION

This application relates to a unique positioning of a discharge tube relative to a pivot axis for a flapper check valve in a compressor.

Compressors are utilized to compress a refrigerant and deliver the compressed refrigerant to a downstream heat exchanger. One type of refrigerant compressor is a scroll compressor. In a scroll compressor, a pair of scroll members each have a base and a generally spiral wrap extending from the base. The wraps interfit to define compression chambers. One of the two scroll members is caused to orbit relative to the other, with the size of the compression chambers decreasing toward discharge as refrigerant is being compressed. After the refrigerant has been compressed, it leaves the compression chambers through a discharge port and into the discharge plenum.

A shell of the compressor is normally divided into a suction plenum and a discharge plenum by a separator plate. Scroll compressors require a check valve located in the discharge passage to prevent the compressor from running in reverse upon shutdown. Reverse rotation can occur at shutdown when the volume of compressed gas contained within the discharge plenum, discharge lines and condenser can drive the orbiting scroll in a reverse direction. This reverse rotation may continue until pressures on the high pressure side of the system equalize with pressures on the low side of the system. Such prolonged reverse rotation is undesirable. The separator plate normally carries a check valve assembly. However, other arrangements are possible where the check valve is installed, for example, directly onto the body of a fixed scroll, if the fixed scroll also serves as a separator plate, being a divider between the suction and discharge plenums. The check valve is opened by fluid pressure, upon the compressor startup and kept open during compressor operation. The check valve is closed by fluid flow, upon the compressor shutdown. The known check valves in many cases are flapper check valves that have a valve member that pivots about a pivot axis between open and closed positions. The valve member pivotal motion is accomplished via a pin that is normally received within hinge slots. When the valve is in the open position, the compressed refrigerant moves outwardly of the compression chambers and into the discharge plenum. When the check valve is closed the refrigerant is blocked from entering the compression chambers. This limits the amount of trapped gas communicating with the compression chambers, and greatly reduces the occurrence of reverse rotation.

One concern with prior art compressors is the wear and fatigue breakage of these flapper check valves. The flapper check valve is typically forced open and allowed to flutter during the compressor operation. The check valve also closes every time the compressor is shutdown. This occurs numerous times during any period of operation of the compressor. Forces acting on these check valves during compressor operation and upon start up and shut down make check valves prone to fatigue and wear failure.

In the prior art, a discharge tube for directing refrigerant from the discharge plenum into a downstream heat exchanger was placed such that the central axis of this tube was perpendicular to an axis that was parallel to the pivot axis of the flapper check valve. With such an orientation, flow streamlines, which extend from the discharge port to the discharge tube, are normal to a face of the flapper valve. This increases the fluid forces on the flapper check valve, and hence the wear and stresses on the flapper check valve components.

SUMMARY OF THE INVENTION

In the disclosed embodiment of this invention, a discharge tube central axis is at an angle that is non-perpendicular to an axis that is parallel to a pivot axis of a flapper check valve in the compressor. As disclosed, the compressor can be a scroll compressor.

With the inventive positioning of the discharge tube relative to the pivot axis, the flow streamlines heading from the discharge port to the discharge tube are no longer normal to the flapper valve surface, and the amount of wear between the valve moving components and fatigue stresses are reduced. This results in dramatic improvement of the check valve reliability.

These and other features of the present invention can be best understood from the following specification and drawings, the following of which is a brief description.

DETAILED DESCRIPTION OF THE PREFERRED EMBODIMENT

Figure 1:
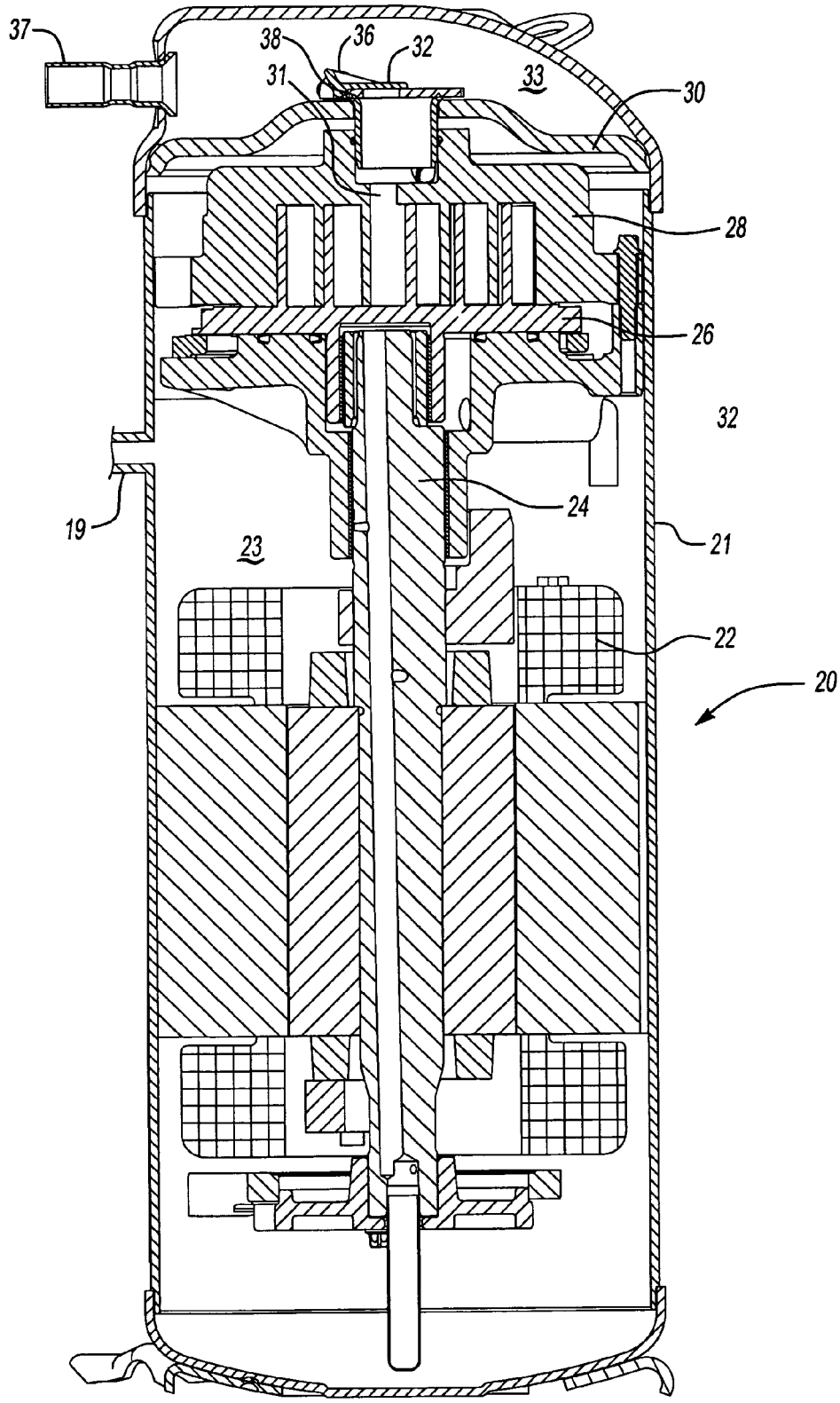
Fig-1 PRIOR ART
FIG. 1 is a cross-sectional view through a prior art compressor.

FIG. 1 shows a prior art compressor 20 incorporating a housing 21 enclosing a motor 22 surrounded by a suction plenum 23. As is known, refrigerant enters the housing 21 through suction port 19 and circulates around the motor 22 and within the suction plenum 23. Refrigerant from the suction plenum 23 moves upwardly into compression chambers defined between an orbiting scroll member 26 and a non-orbiting scroll member 28. As is known, the motor 22 drives a rotating shaft 24 to cause the orbiting scroll 26 to orbit. As further shown, a separator plate 30 divides the inside of the housing 21 into the suction plenum 23 and a discharge plenum 33. A discharge port 31 extends from the compression chambers to pass a compressed refrigerant from the compression chambers into the discharge plenum 33. As shown, a check valve arrangement 32, with the valve shown in closed position, includes a flapper valve member 36. A discharge tube 37 communicates the refrigerant outwardly of the discharge plenum 33 and then to a condenser heat exchanger. As is clear from FIG. 1, the discharge tube 37 is on one side of the separator Plate 30, and the motor 22 and suction plenum 23 are on an opposed side.

Figure 1A:
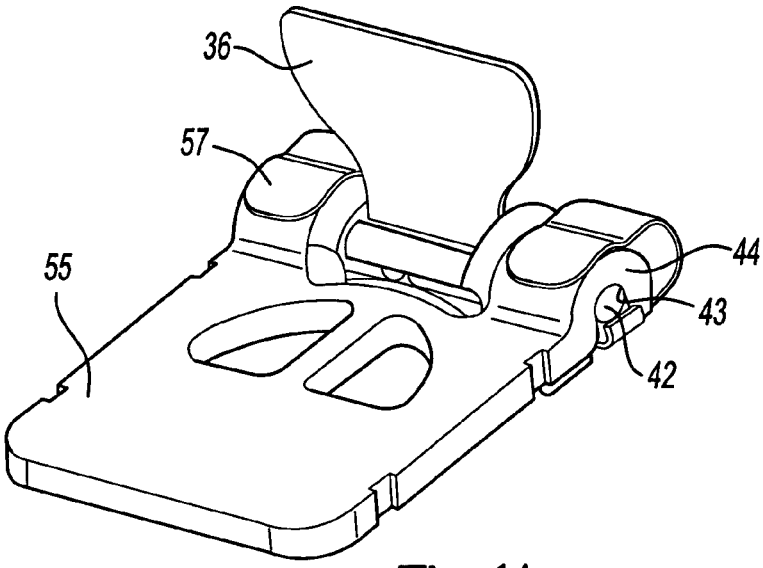
Fig-1A PRIOR ART
FIG. 1A shows a detail of the prior art valve.
Figure 2:
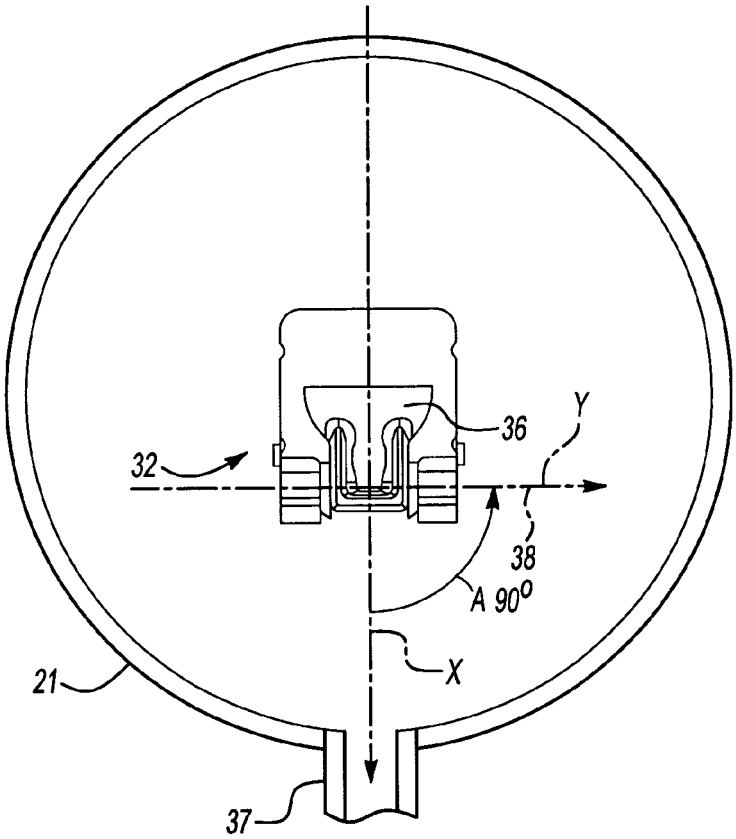
Fig-2 PRIOR ART
FIG. 2 is a top view of the prior art compressor.

The detail of the check valve is shown in FIG. 1A. The valve is generally constructed as described in U.S. Pat. Nos. 6,123,528 and 6,264,452 by the same assignee and may operate generally as shown in U.S. Pat. No. 5,088,905. One of the possible valve assembles is shown in FIGS. 1A and 2, where the valve reed 36 is free to pivot. The valve pivotal axis passes through the center of a pin 42 received in slots 43 on a hinge mount 44 that is part of the valve plate 55 attached to a separator plate 30. The pin and the valve reed are retained within the check valve assembly by a spring clip 57.

Figure 3:
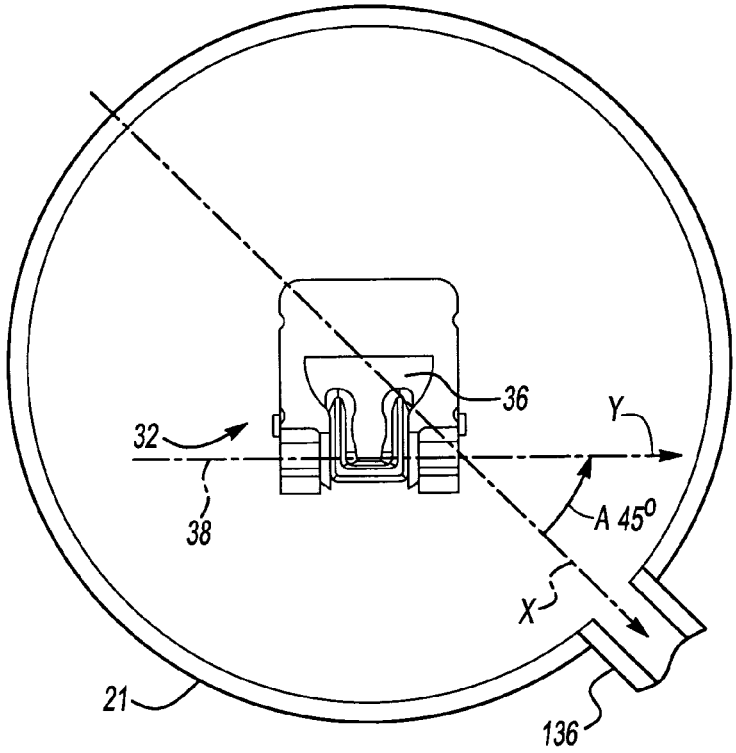
FIG. 3 shows an inventive compressor.
Figure 4:
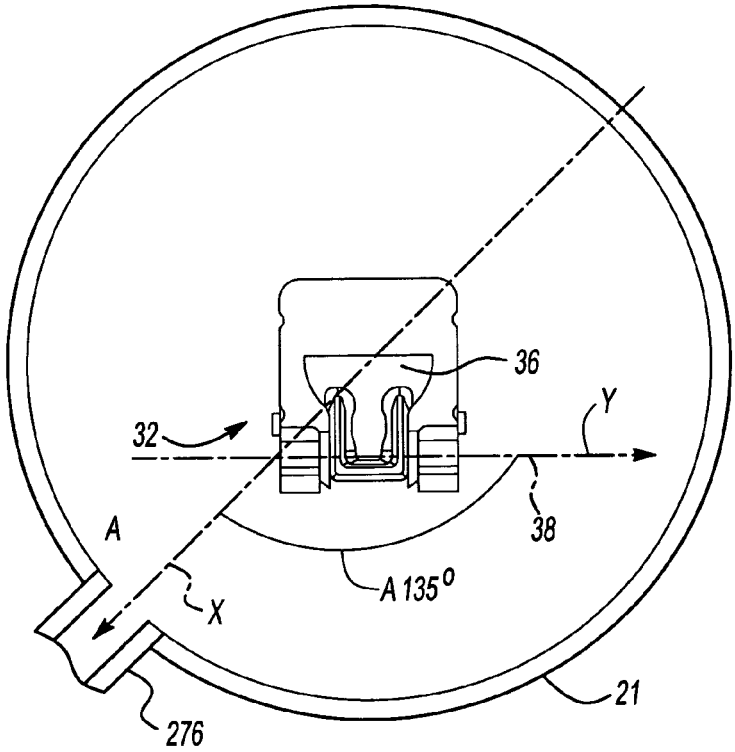
FIG. 4 shows another embodiment.

As shown in FIGS. 2-4, the discharge tube 37 is centered on an axis X. An axis 38, called axis Y, is defined as being parallel to a pin 42 and as also being in the same plane as axis X. The positive direction of axis X is defined as being toward the discharge tube from inside of the housing 21. The discharge tube is defined as 37, 136 and 276 for FIGS. 2, 3, and 4 respectively) and the positive direction of the Y axis is defined from left to right looking downward on the check valve assembly. The intersection angle between these two axes is defined as originating in the counter clockwise direction on the positive portion of the axis X and terminating on a positive portion of the axis Y. The prior art arrangement is shown in FIG. 2, where the Y and X axes are perpendicular to each other. With such a prior art orientation, the flow streamlines, which extend from the discharge port 31 to the discharge tube 37 are normal to a face of the flapper valve. This increases the fluid forces on the valve when the valve is in the open position, it also increase the impact force against the valve seat when the valve is forced to close upon the compressor shutdown. These increased fluid forces can lead to wear and excessive stresses on the check valve flapper member, pin, and hinges, potentially causing these components to break.

FIG. 3 shows the inventive arrangement in which an axis X of the discharge tube 136 is rotated with respect to the valve to be no longer perpendicular to the axis Y. Instead, the angle A as shown in FIG. 3 is roughly at 45° and can be preferably selected to be between 0 and 85°, and more preferably between 30 and 60°. There can also be a similar arrangement as shown in FIG. 4 where the tube 276 is rotated in the opposite direction of what was shown in FIG. 3. In this case, as shown in FIG. 4, this angle A is roughly equal to 13520 and can be selected to be preferably between 95 and 180°, and more preferably between 120 and 150°.

With the inventive positioning, the flow streamlines, which extend from the discharge port 31 to the discharge tube 37 are no longer normal to a face of the flapper valve, thus benefits of reduced stresses acting on the valve components are achieved as mentioned. It has been found that the inventive positioning of the pivot axis relative to the discharge tube has resulted in a much better performance of the flapper valves, with the flapper valves surviving under extremes of operating conditions without substantial wear or any breakage.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base, a second scroll member having a base and a generally spiral wrap extending from its base, said wraps of said first and second scroll members interfitting to define compression chambers, said second scroll member being caused to orbit relative to said first scroll member; and a housing for sealing said first and second scroll members, said housing further receiving a separator plate, said separator plate separating an interior of said housing into a suction plenum and a discharge plenum, and a check valve mounted on said separator plate, said check valve including a flapper valve for controlling flow of refrigerant in said discharge plenum, said flapper pivoting about a pivot axis, and a discharge tube for communicating refrigerant in said discharge plenum with refrigerant located outward of said housing, said discharge tube being centered on a first axis that is at a non-perpendicular angle to a second axis that is both parallel to said pivot axis and is in the same plane as said first axis, said first axis intersecting said second axis to define said non-perpendicular angle.

2. The scroll compressor as set forth in claim 1, wherein said angle is between 0 and 85°.

3. The scroll compressor as set forth in claim 2, wherein said angle is between 30 and 60°.

4. The compressor as set forth in claim 1, wherein said angle is between 95 and 180°.

5. The compressor as set forth in claim 1, wherein said angle is between 120 and 150°.

6. The scroll compressor as set forth in claim 1, wherein said angle is approximately 45°.

7. The scroll compressor as set forth in claim 1, wherein said flapper valve including a pin which rotates with said flapper valve, and is mounted within a housing to define said pivot axis.

8. A scroll compressor comprising:

a first scroll member having a base and a generally spiral wrap extending from said base, a second scroll member having a base and a generally spiral wrap extending from its base, said wraps of said first and second scroll members interfitting to define compression chambers, said second scroll member being caused to orbit relative to said first scroll member, a housing for sealing said first and second scroll members, said housing further receiving a separation member separating an interior of said housing into a suction plenum and a discharge plenum, a flapper valve for controlling flow of refrigerant in said discharge plenum, said flapper valve pivoting about a pivot axis, and a discharge tube for communicating refrigerant in said discharge plenum outward of said housing, said discharge tube being centered on a first axis that is at a non-perpendicular angle to a second axis that is both parallel to said pivot axis and is in the same plane as said first axis, said flapper valve pivoting with a pin member in a housing to define said pivot axis; and said discharge tube being on the same side of said separation member as said discharge plenum, such that said discharge tube does not cross said separation member and extend toward said suction plenum.

9. The scroll compressor as set forth in claim 8, wherein said separation member is an element separate from said first scroll member.

* * * * *